United States Patent [19]

Tufts et al.

[11] 4,217,187

[45] Aug. 12, 1980

[54] OPERATION OF ELECTROLYTIC DIAPHRAGM CELLS UTILIZING INTERRUPTABLE OR OFF-PEAK POWER

[75] Inventors: Lewis E. Tufts, Lewiston, N.Y.; Bernardus J. Mentz, Maple Ridge, Canada

[73] Assignee: Hooker Chemicals & Plastics Corp., Niagara Falls, N.Y.

[21] Appl. No.: 39,998

[22] Filed: May 17, 1979

[51] Int. Cl.[2] ..... C25B 1/34

[52] U.S. Cl. ..... 204/98; 204/128

[58] Field of Search ..... 204/98, 128

[56] References Cited

U.S. PATENT DOCUMENTS

| | | | |
|---|---|---|---|
| 3,467,586 | 9/1969 | Grootheer et al. . | |
| 3,485,730 | 12/1969 | Virgil . | |
| 3,630,863 | 12/1971 | Jeffery et al. . | |
| 3,948,737 | 4/1976 | Cook | 204/98 |
| 3,988,223 | 10/1976 | Hirozawa | 204/98 |
| 4,115,218 | 9/1978 | Krumpelt | 204/98 |
| 4,118,308 | 10/1978 | Specht . | |

*Primary Examiner*—R. L. Andrews

*Attorney, Agent, or Firm*—Howard M. Ellis; William G. Gosz; Peter F. Casella

[57] ABSTRACT

A method of operating a plurality of electrolytic diaphragm cells utilizing interruptable or off-peak electrical power varying from a higher electrical load level to a lesser electrical load level and subsequently returning to a selected higher electrical load level is described, which comprises the steps of:

(a) reducing the brine feed into each cell in an amount at least about proportional to the scheduled electrical load reduction, (b) reducing the electrical load from a higher level to a lower level over a time period of not less than about 20 minutes, (c) operating the cells at such lower electrical load level until additional current is available, and, when additional current is available, (d) increasing the brine feed into each cell to between about 100 and about 150 percent of the original feed rate, (e) increasing the electrical load level to a selected higher level over a period of not less than about 10 minutes, (f) adjusting the brine feed to the original feed rate, and (g) maintaining the caustic concentration leaving the cell diaphragms during steps (a) through (f) at least about 90 grams per liter.

9 Claims, No Drawings

OPERATION OF ELECTROLYTIC DIAPHRAGM CELLS UTILIZING INTERRUPTABLE OR OFF-PEAK POWER

BACKGROUND OF THE INVENTION

The present invention relates to a method of operating electrolytic cells utilizing a source of electric current having varying electrical load levels. More in particular, the present invention relates to the operation of a plurality of electrolytic diaphragm cells for the electrolysis of aqueous alkali metal chloride solutions by a method suited to the use of interruptable or off-peak power.

Electrolytic cells have been used extensively for many years for the production of chlorine, chlorates, perchlorates, caustic, hydrogen and other chemicals. Over the years, such cells have been developed to a degree whereby high operating efficiencies have been obtained. One of the more recent developments in electrolytic cells has been in maintaining high operating efficiencies while drastically increasing the current capacities at which the individual cells operate. The increased production capacities of the individual cells operating at high current capacities is advantageous, providing higher production rates for any given cell room floor space, thus, reducing capital and operating expenses.

The present method of operating electrolytic diaphragm cells may be utilized in various processes. Chlor-alkali diaphragm cells are presently of primary commercial importance, and, therefore, the present invention will be described in terms of such cells. However, it will be understood that the following description is not to be interpreted as limiting the usefulness of the present method to chlor-alkali diaphragm cells.

Typically, an electrolytic cell installation consists of a plurality of cells electrically connected serially together in groups called circuits. Usually, circuits consist of from about 10 to about 100 cells. In the case of diaphragm cells, each cell has an anode and a cathode separated by a diaphragm of fluid-permeable, corrosion-resistant material. Suitable diaphragm materials are asbestos, resins or mixtures thereof. In the case of a chlor-alkali cell, an aqueous brine (sodium chloride) is fed into the anolyte compartment, and, upon the application of an electrolyzing, or decomposing current to the electrodes, gaseous chlorine is produced at the anode and sodium hydroxide and gaseous hydrogen are produced at the cathode. The sodium hydroxide is dissolved in the cell liquor leaving the cell from the catholyte compartment. Chlor-alkali cells have been developed and are now in commercial use which operate at current levels of 150,000 to 200,000 amperes.

The major expense of operating chlor-alkali cells is electrical current. Typically, sources of electrical current, utilities, have a relatively fixed capacity to supply power, while the demand usually has large daily and seasonal variations. The differences between capacity and periods of low demand is termed interruptable or "off-peak" power and is available at a lesser rate if the purchaser agrees to accept load decreases when the demand otherwise increases. The operation of electrolytic cell installations utilizing interruptable power is highly desirable from an economic standpoint; however, such use of interruptable power has not heretofore proved successful in installations utilizing diaphragm cells because the necessary and frequent variations in the load have caused permanent tightening of the cell diaphragms to the extent that liquid flow through the diaphragms is severely curtailed. The loss of diaphragm porosity requires the entire cell circuit to be subsequently operated on a reduced electrical load to prevent severe operating difficulties. The result of such diaphragm tightening is that the total original production capacity of the installation is reduced until the overly tight diaphragms are replaced. The present process provides a means of maximizing the use of available interruptable power while minimizing the possibilities of such operating difficulties.

BREIF DESCRIPTION OF THE INVENTION

The present invention provides a method of operating a plurality of electrolytic diaphragm cells utilizing a source of electrical current varying in load level over a period of time. The adaptation of the electrolytic cell operation is available power usually follows a pattern of adjusting the cell operation to a downward variation in electrical load to some lesser level with a subsequent increasing after a period of time to a selected higher load level. Such variation is called a load cycle. A load cycle may be considered to have three stages:

(a) an initial load reduction stage, (b) a low load equilibrium stage, and (c) a load increasing stage to reach a higher selected load level.

Typically, the supplier of electrical current will give the purchaser of interruptable power an advance notification of from about 20 minutes to about one hour to reduce or cease use of uninterruptable power.

The process of the present invention requires specific steps to be taken in sequence to minimize or obviate diaphragm tightening. The steps comprise:

(a) reducing the amount of brine feed into each cell in an amount at least about proportional to the scheduled electrical load reduction, (b) reducing the electrical load to a lower level over a period of not less than about 20 minutes, (c) operating the cells at a lower electrical load level until additional current is available, and when additional current is available, (d) increasing the brine feed into each cell to an amount between about 100 and about 150 percent of the original rate, (e) increasing the electrical load to a selected higher level over a time period of not less than about 10 minutes, (f) adjusting the brine feed to the original feed rate, and (g) maintaining the caustic concentration leaving the diaphragm during steps (a) through (f) at a level of at least 90 grams per liter.

DETAILED DESCRIPTION OF THE INVENTION

The present invention relates to the use of interruptable power to operate electrolytic diaphragm cells and is particularly adapted to the utilization of electrolytic cells operating at higher electrode current densities, generally in the neighborhood of 1.5 asi (amperes per square inch). Typically, such cells operate at current levels of 150,000 amperes or more. In a preferred operating mode, a power supply commitment is made to receive a fixed load of "firm", or continuously available, power and a varying load of interruptable, or discontinuously available, power. For example, half of the electrical load for full cell capacity may be continuously available and half interruptable. The present invention is particularly adapted to situations wherein the load is required to be reduced by at least about 20 percent.

Looking now at the steps of the present process in detail:

REDUCTION OF BRINE FEED

Prior to a reduction in electrical load, the rate of brine fed into the individual cells in the cell circuit is reduced. The reduction in brine feed is at least about proportional to the amount that the electrical load is to be reduced. Thus, if the electrical load is to be reduced 50 percent, the brine feed is also reduced at least about 50 percent.

A cell circuit may contain some new cells or reconditioned cells having new diaphragms. Such cells typically have a high flow rate through the cell diaphragm. In order to maintain a safe level of anolyte in such cells, an initial increase in brine feed to such individual cells may be required. This adjustment is preferably made prior to the reduction in the brine feed for the entire circuit. An estimate of the amount of increase for such individual cells may be made by dividing 100 by the percent of the original electrical load which will be maintained at the lower level. Thus, if the electrical load is to be decreased from 120,000 amperes to 75,000 amperes, the lower load level will be 62.5% of the original load. The brine feed to the faster running cells would be adjusted to 100/62.5, or about 1.6 times the initial rate.

In load reductions greater than about 25 percent, the decrease in brine feed is preferably made from about 10 to about 30 and, typically, about 20 minutes prior to the load reduction.

Preferably, the reduction in brine feed is carried out over the entire circuit by decreasing a common brine supply to the circuit. Such overall reduction may suitably be carried out by a reduction in the brine header pressure.

REDUCTION OF ELECTRICAL LOAD

The electrical load reduction may be carried out over a relatively short period of time, preferably not less than about 20 minutes, and typically from about 20 minutes for lesser reductions to about one hour for larger reductions. The electrical load reductions may be carried out either continuously or by making a number of incremental reductions over the time period; for example, typical reductions are about 5,000 amperes every two minutes.

LOW LOAD CELL OPERATION

Generally, the electrolytic cell operation at low electrical load level is merely operating the circuit at less than capacity until power is again available to operate the circuit at a higher or full capacity. The brine feed rate may suitably be increased to a rate higher than that utilized in the load reduction step to insure a safe anolyte level in cells which would otherwise require individual adjustments. Typically, increases in the order of 5 to 30 percent may be made, provided the caustic concentration in the cell liquor leaving the diaphragm is maintained above about 90 gpl (grams per liter).

INCREASE OF BRINE FEED

Prior to again increasing the electrical load to the original level as additional current becomes available, the brine feed to the cells is increased to a level between about 100 and about 150 percent of the original feed rate. Generally, this increased feed rate is started from about 15 to about 30 minutes, and, typically, about 20 minutes, prior to increasing the electrical load. Suitably, the increase in brine feed is carried out over the entire circuit by increasing the brine header pressure.

INCREASE OF ELECTRICAL LOAD

After the increase in brine feed has taken place, the electrical load is increased to a higher level, preferably over a time period of at least about 10 minutes. Typically, the load is increased incrementally at about 5,000 amperes every two minutes.

ADJUSTMENT OF BRINE FEED

After the load has been increased to the higher level, the brine feed rate is adjusted, if required, to normal, suitably by adjusting the brine header pressure for the entire circuit. Brine feed rate adjustments may be made to individual cells to assure an adequate anolyte level and a satisfactory sodium hydroxide concentration in the cell liquor.

CAUSTIC CONCENTRATION IN THE DIAPHRAGM

Typically, electrolytic cells operate with a caustic (sodium hydroxide) concentration in the cell liquor between about 130 and about 170 gpl (grams per liter) and, more preferably, between about 140 and about 150 gpl. Under equilibrium conditions, the caustic concentration in the cell liquor is a measure of the caustic concentration leaving the cell diaphragm. It is postulated that tightening of the diaphragms in electrolytic cells is related to the caustic concentration in the diaphragm and that the effectiveness of the sequential steps of the present process to alleviate tightening depends upon maintenance of an adequate concentration of caustic in the diaphragm. The caustic concentration leaving the cell diaphragms during the present process steps should be maintained at a level of at least about 90 gpl.

TABLE 1

The following table illustrates typical load cycling utilizing the present invention:

TABLE I

| Run | Percent Load Reduction | Minutes of Brine Feed Reduction Before Load Reduction | Percent Brine Flow During Load Reduction | Percent Brine Flow at Low Load | Percent Brine Flow Prior to Load Increase |
|---|---|---|---|---|---|
| 1 | 20 | 0 | 80 | 86 | 100 |
| 2 | 30 | 10 | 70 | 79 | 100 |
| 3 | 40 | 20 | 60 | 72 | 125 |
| 4 | 50 | 20 | 50 | 65 | 125 |

Thus, in Run 4, the electrical load reduction was to be 50 percent. Twenty minutes prior to the reduction, the brine flow into the cells was reduced to 50 percent. After the load level was reduced, the brine flow into the cells was increased to 65 percent of the original rate. Prior to an increase in the load, the brine flow into the cells was increased to 125 percent of the original rate.

The foregoing description and embodiments are intended to illustrate the invention without limiting it thereby. It will be understood that various modifications can be made in the invention without departing from the spirit or scope thereof.

What is claimed is:

1. A method of operating a plurality of electrolytic diaphragm cells for the electrolysis of alkali metal halides utilizing electrical current varying from a higher level to a lesser level and subsequently increasing to a selected higher level which comprises the steps of:

(a) reducing the amount of brine feed into each cell in an amount at least about proportional to a scheduled electrical load reduction, (b) reducing the electrical load from said higher level to a lower level over a time period of not less than about 20 minutes, (c) operating such cells at such lower electrical load level until additional current is available, and, when additional current is available, (d) increasing the brine feed into each cell to between about 100 and about 150 percent of the original feed rate, (e) increasing the electrical load level to said selected high level over a period of not less than about 10 minutes, (f) adjusting the brine feed to the original feed rate, and (g) maintaining the caustic concentration leaving the cell diaphragms during steps (a) through (f) to at least about 90 grams per liter.

2. The method of claim 1 wherein the diaphragm cells are chlor-alkali cells.

3. The method of claim 2 wherein the chlor-alkali cell is equipped with a diaphragm made from a material selected from the group consisting of asbestos, resins and mixtures thereof.

4. The method of claim 1 wherein the cells have a common brine source and the brine feed adjustments in steps (a), (d), and (f) are carried out by adjusting the flow rate of the brine in said common source.

5. The method of claim 1 wherein step (a) is conducted up to about 45 minutes prior to step (b).

6. The method of claim 1 wherein the electrical load in step (b) is incrementally reduced.

7. The method of claim 1 wherein step (d) is conducted up to about 30 minutes prior to step (e).

8. The method of claim 1 wherein step (e) is conducted incrementally.

9. The method of operating a plurality of chlor-alkali cells according to the procedure of claim 1 during periods of interruptable or off-peak power.

* * * * *